United States Patent [19]

Miura

[11] 4,091,590

[45] May 30, 1978

[54] STRUCTURAL ELEMENT

[76] Inventor: Hirokazu Miura, 536, Kamiumamachi, Shibutani-dori Higashiyama-ku, Kyoto, Japan

[21] Appl. No.: 804,281

[22] Filed: June 7, 1977

[51] Int. Cl.[2] ..... E04C 1/10

[52] U.S. Cl. ..... 52/585; 52/592

[58] Field of Search ..... 52/585, 590, 591, 592, 52/593, 596, 606, 607, 100, 565, 405

[56] References Cited

U.S. PATENT DOCUMENTS

| | | | |
|---|---|---|---|
| 2,326,708 | 8/1943 | Wanner | 52/100 |
| 3,416,281 | 12/1968 | Kopp | 52/606 |
| 3,603,060 | 9/1971 | Kay | 52/593 X |

*Primary Examiner*—Ernest R. Purser
*Assistant Examiner*—Carl D. Friedman
*Attorney, Agent, or Firm*—Fidelman, Wolffe & Waldron

[57] ABSTRACT

A structural element for use as a component part of a building, comprising a pair of parallel elongated rectangular side plates having opposite surfaces spaced a distance apart from each other and connecting means disposed between the side plates so as to rigidly connect the side plates in the spaced-apart relation. The connecting means can be a single elongated rectangular flat plate having its opposite longitudinal side edges fixed to the opposite surfaces of the side plates along the center lines thereof so as to form the side plates and the connecting plate into an integral element of an H-shaped cross section. The connecting means can also be a channel member of a U-shaped cross section comprising a base plate and a pair of side walls the outer surfaces of which are fixed to the opposite surfaces of the side plates so as to form the side plates and the connecting plate into an integral element of a U-shaped cross section. A plurality of U-shaped channel members may also be used.

23 Claims, 29 Drawing Figures

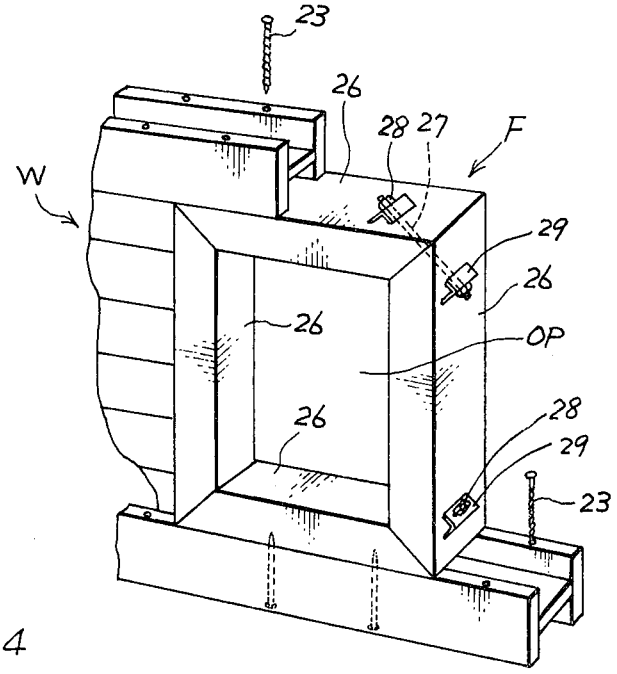
Fig. 5
Fig. 4
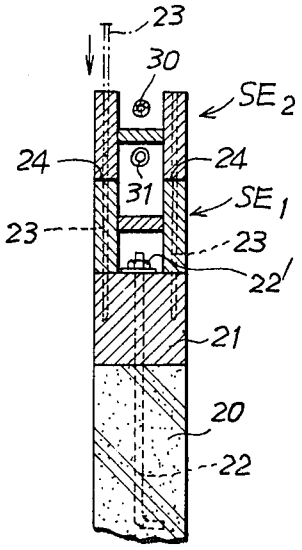
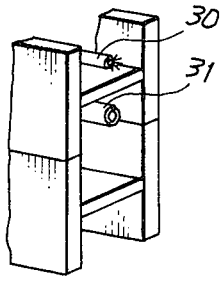
Fig. 10
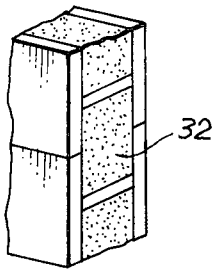
Fig. 11

Fig. 6
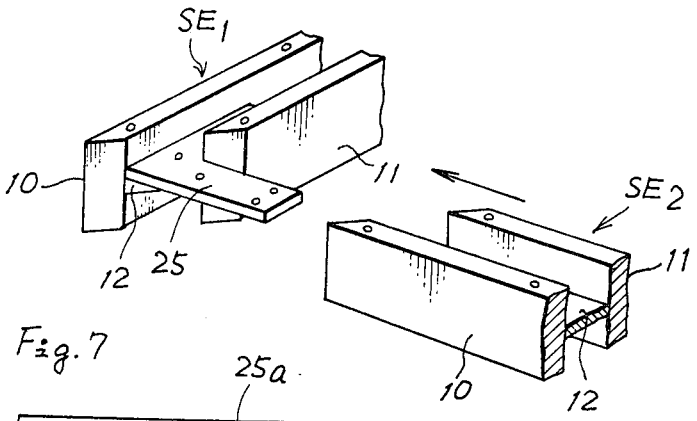
Fig. 7
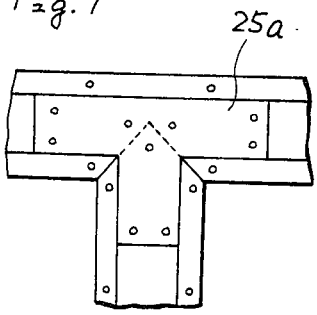
Fig. 9
Fig. 8
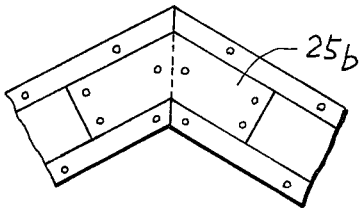
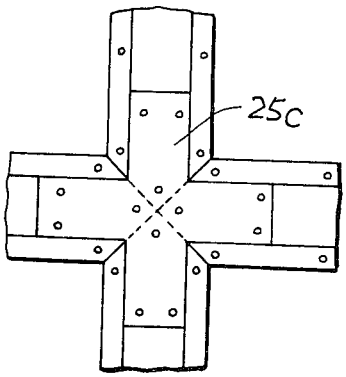

STRUCTURAL ELEMENT

This invention relates to a building material, and more particularly to a structural element which can be used as various component parts of a building, such as a beam, a pillar, a wall, flooring, ceiling, etc.

Since the beginning of history man has been using wood as a building material as well as for various other purposes. With the development of modern science and engineering, other materials such as metals and plastics have replaced wood in many cases, but wood still remains one of the important materials for many reasons. Wood is comparatively light in weight and free from rust and corrosion, has durability and beauty and great ability to absorb shocks from sudden loads, and can be easily worked. Although it takes many years for tree to grow up sufficiently to provide lumber for use as building material, nature can provide substantially inexhaustible sources of supply of wood provided that a good care is taken of the existing sources of supply and consumption of wood is properly controlled and made up for by well-planned reproduction.

It is well in architecture that a structure having an H-shaped cross section has great strength and high stability from the viewpoint of the theory of structures. However, such a structual member having an H-shaped cross section has been in considerably limited use in wooden building. This is because there have been available few such structural elements which can be used in such a manner as to satisfy various requirements of modern wooden buildings, such as low manufacturing cost, adaptability for mass production, high workability and applicability, economy of material, etc.

Accordingly, the primary object of the invention is to provide a structural element having a generally H-shaped cross section which can be used as a component of various parts of a building, such as beam, a pillar, a wall, flooring and ceiling.

Another object of the invention is to provide such a structural element as aforesaid which has an increased strength from the viewpoint of the theory of structures.

Another object of the invention is to provide such a structural element as aforesaid which uses a considerably small quantity of material.

Still another object of the invention is to provide such a structural element as aforesaid which is easy to manufacture, and very low in cost and can be easily worked and adapted to provide good acoustic and thermal insulation.

Other objects and advantages of the invention will be clearly understood from the following description of preferred embodiments thereof with reference to the accompanying drawings, wherein the same reference numerals and symbols in different figures designate corresponding parts and wherein;

FIG. 4 is a vertical sectional view of a wall made by the elements shown in FIGS. 1 or 2;

FIG. 5 is a perspective view of a wall made by the elements shown in FIGS. 1 or 2, with an opening formed therein;

FIG. 6 is a perspective view showing a manner of connecting the ends of two structural elements shown in FIGS. 1 or 2 perpendicularly to each other;

FIGS. 7, 8 and 9 are top plan views showing different manners of connecting the ends of the structural elements;

FIG. 10 is a perspective view of the end portion of two piled elements with a pipe and a cable passing through the space within the elements;

FIG. 11 is a view similar to FIG. 10 but showing the space filled with a thermal and/or acoustic insulating material.

FIGS. 22A through 25A are end views showing modified forms of the elements shown in FIGS. 22 through 25, respectively.

Broadly speaking, the structural element of the invention comprises a pair of parallel elongated rectanguar side plates made of wood having opposite surfaces spaced apart from each other, and connecting means disposed between the opposite surfaces of the pair of plates so as to rigidly connect and keep the pair of side plates in the parallel spaced-apart relation.

In one embodiment of the invention the connecting means comprises an elongated rectangular plate of substantially the same length as the pair of side plates, with its opposite lateral edges fixed to the inner opposite surfaces of the side plates by means of adhesive or suitable mechanical joint.

In another embodiment of the invention, the connecting means comprises a channel member having a pair of opposite lateral walls and a bottom or base wall connecting the lateral walls so that the channel member has a generally U-shaped cross section. The outer surfaces of the lateral walls of the channel member are attached by adhesive or otherwise fixed to the opposite inner surfaces of the side plates.

In still another embodiment of the invention, the connecting means comprises a pair of such channel members as mentioned above, each having the outer surfaces of its opposite lateral wall adhered to the inner surfaces of the side plates. The bottom walls of the two connecting channel members may have their outer surfaces in contact with or spaced a small gap apart from each other. The two channel members may be so arranged between the side plates that they are piled one upon the other. There may be provided more than three such channel members arranged one upon another between the opposite side plates.

Figure 1:
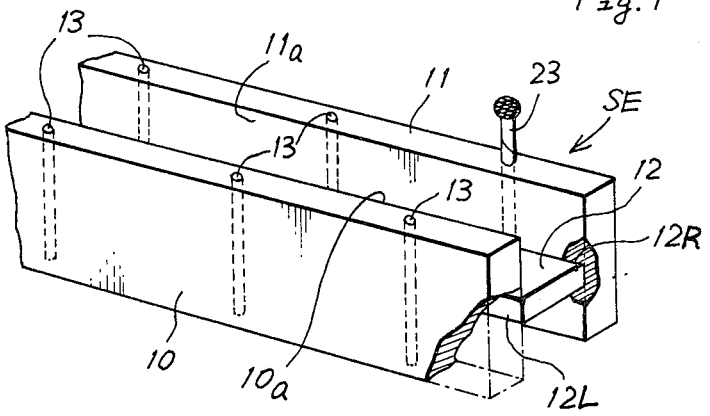
FIG. 1 is a perspective view, partly broken, of a portion of a structural element embodying the invention.

Now referring in detail to the drawings, first to FIG. 1, there is shown a structural element SE comprising a pair of parallel elongated rectangular side plates 10 and 11 of a predetermined length having opposite surfaces 10*a* and 11*a* spaced a predetermined distance apart from each other. A connecting plate 12 of a similar elongated rectangular shape and substantially the same length as that of the side plates 10 and 11 is disposed between the side plates so as to extend longitudinally thereof, with its plane arranged perpendicularly to the planes of the side plates and its opposite edge. Surfaces 12L and 12R are adhered by suitable adhesive to the opposite surfaces 10*a* and 11*a* of the side plates 10 and 11 along the center lines thereof so that the side plates are rigidly connected by the connecting plate 12 in a parallel spaced-apart relation to form the integral structural element SE.

A plurality of through bores 13 are formed in the side plates transversely or widthwise thereof for the purpose to be described later.

Figure 3:
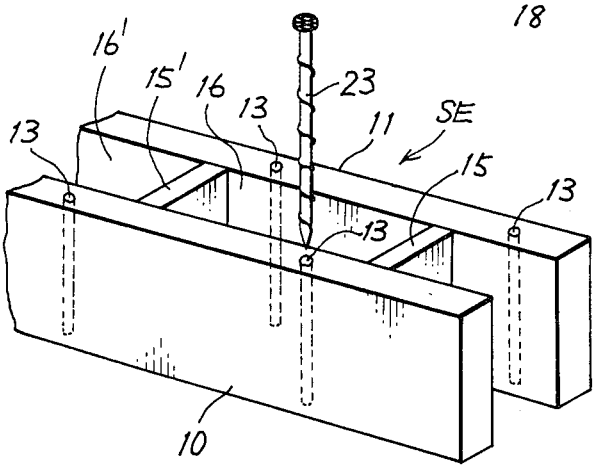
FIG. 3 is a perspective view of still another embodiment of the invention.

In the embodiment of FIG. 3 the two side plates 10 and 11 are connected by a plurality of connecting plates 15, 15', . . ., each of which extends transversely or widthwise of the side plates and perpendicularly thereto so that the longitudinal space between the side plates 10 and 11 are divided into a plurality of separate sections 16, 16', . . . .

FIGS. 4 and 5 show how to assemble a plurality of structural elements into a wall W of a building. There is shown a foundation 20 made of concrete, to which a sill 21 comprising a piece of lumber having a square cross section is secured by means of an anchor bolt 22 and a nut 22'. To the upper surface of the sill 21 is secured a structural element SE1 by means of nails 23 struck or screwed through the through bores 13 into the sill. On the structural element SE1 another structural element SE2 is placed with the lower edge surfaces of the side plates thereof in contact with the upper edge surfaces of the side plates of the lower element SE1, with nails 23 struck or screwed through the through bores 13 of the side plates of the upper element SE2 into the side plates of the lower element SE1.

Adhesive 24 may be applied to the contacting edge surfaces of the side plates of the two elements SE1 and SE2 to strengthen the connection thereof by the nails 23.

In a similar manner as many elements as are desired may be successively piled up and secured to each other so that the wall W is formed.

Figure 2:
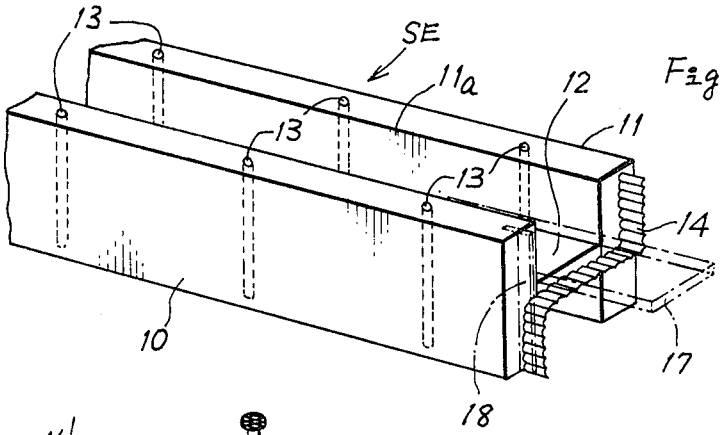
FIG. 2 is a perspective view of another embodiment of the invention.

To connect two elements in axial alignment, that is, in an end-to-end relation, a splice plate 17 may be used as shown in FIG. 2 to connect the adjacent end portions of two structural elements to be connected. A substantially Z-shaped piece of metal 14 has its opposite lateral edges struck into the opposite end faces of the two structural elements so as to prevent invasion of rain or water trough the splice connection into the inside of the wall if the side plates 10 face outward. Instead of the Z-shaped member, a simple plate 18 may have its opposite lateral sides inserted into a groove formed in each of the abutting end faces of the side plates 10 of the spliced elements. Alternatively or in addition to the mechanical seal, a suitable sealing or caulking material can be used.

In FIG. 6 two elements SE1 and SE2 have their respective abutting ends cut off aslant so that an L-shaped splice plate 25 connects the two elements at right angles with each other.

FIGS. 7 to 9 show by way of example different manners of connecting two or more structural elements by splice plates 25*a*, 25*b* and 25*c* of different shapes. These figures are self-explanatory so that no explanation thereof will be given.

Returing to FIG. 5, there may be formed in the wall W an opening OP defined by a rectangular frame F comprising four pieces of lumber 26 connected by a bolt 27 and a pair of nuts 28 with a pair of angle members 29.

The wall structure constructed in the above manner is hollow, that is, has an inner space. The space may include electric wires or cables 30, piping 31 for air conditioning and any other installation, as shown in FIGS. 4 and 10. Alternatively, the hollow space inside the wall may be filled with a suitable material 32 such as glass wool for thermal and acoustic insulation and/or concrete for structural reinforcement as shown in FIG. 11.

Figure 12:
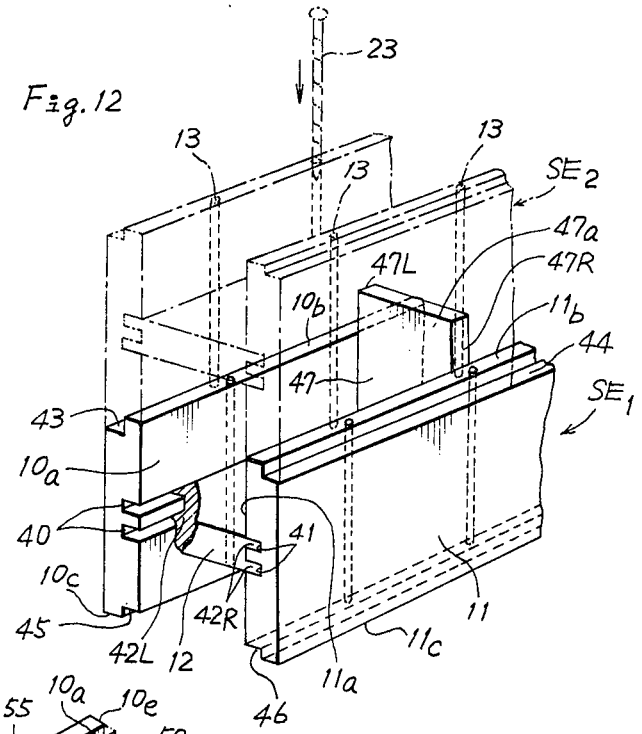
FIG. 12 is a perspective view of a modified form of the element shown in FIG. 1.

FIG. 12 shows a modified form of the structural element shown in FIG. 1. In the arrangement of FIG. 12, the side plates 10 and 11 are provided on the opposite surfaces 10*a* and 11*a* thereof with a pair of parallel grooves 40 and 41 extending longitudinally of the plates, and a corresponding pair of longitudinal tongues 42R and 42L are formed on the opposite edges of the connecting plate 12, so that the tongues engage in the grooves for securer connection of the plate 12 to the side plates 10 and 11. Adhesive may be used to increase the rigidity of the connection.

A step or shoulder 43, 44 is formed on the outer side of the upper edge surface 10*b*, 11*b* of each of the side plates 10 and 11 so as to extend along the whole length thereof.

Another step or shoulder 45, 46 is formed on the inner side of the lower edge surfaces 10*c*, 11*c* of each of the side plates so as to extend along the whole length thereof. The shoulders 43, 44, 45 and 46 are provided to have two structural elements SE1 and SE2 one upon another for securer assembly thereof than without such stepped joint.

A plurality of stiffeners, only one of which is shown at 47, are provided between the side plates 10 and 11 on the connecting plate 12 in such a manner that they divide the longitudinal space between the side plates 10 and 11 and above the connecting plate 12 into a plurality of separate sections. Each of the stiffener plates has the lower portions of its opposite edges 47L and 47R adhered to the opposite inner surfaces 10*a* and 11*a* of the side plates 10 and 11, with its upper portion 47*a* projecting above the upper edges 10*b* and 11*b* of the side plates 10 and 11 so that when the two structural elements SE1 and SE2 are assembled one upon another as shown in FIG. 12 the upper portion 47*a* of the stiffener 47 of the lower structural element SE1 engages in between the side plates 10 and 11 of the upper structural element SE2 for securer connection of the two elements while simultaneously functioning as a stiffener below the connecting plate 12 of the upper element.

As can be easily seen, in order to form a wall such as shown in FIG. 5 a plurality of structural elements as shown in FIG. 12 are piled one upon another, with the previously described halving connection between the upper and lower elements preferably strengthened by nails 23 struck or screwed through the bores 13 in the side plates of the upper element SE2 into the side plates of the lower element SE1.

Figure 13:
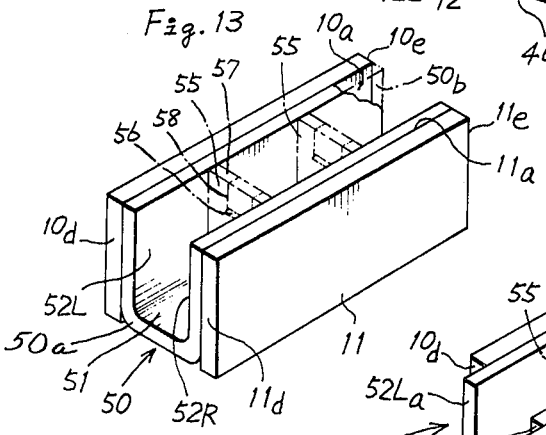
FIGS. 13 through 18 are perspective views showing different embodiments of the invention including a U-shaped channel member.

FIG. 13 shows still another embodiment of the invention, wherein the opposite side plates 10 and 11 are connected by a channel member 50 of a substantially U-shaped cross section. The channel member has substantially the same length as the side plates 10 and 11 and comprises a bottom or base plate 51 and a pair of opposite side walls 52R and 52L standing upright from the opposite sides of the bottom plate 51. The channel member 50 is preferably made of a sheet of plywood by bending the side portions thereof by means of, e.g., a hot-press, although it may also be made of any other suitable material such as plastics, metal, asbestos, etc.

The outer lateral surfaces of the side walls 52L and 52R of the channel member are fixed to the inner opposite surfaces 10*a* and 11*a* of the side plates 10 and 11, respectively, by adhesive or a suitable mechanical device such as secret nails, bolts, or by both adhesive and such a mechanical member.

The side plates may be made of any suitable material such as wood, metal, asbestos, plastics, etc.

Figure 14:
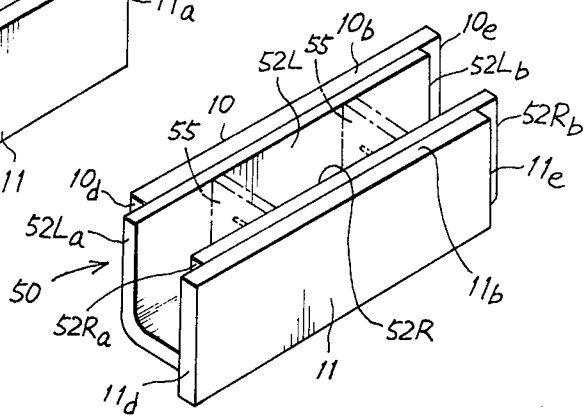

In FIG. 13, the longitudinal end faces 10*d* and 11*d* (and also 10*e* and 11*e*) of the side plates are in the same plane as the end face 50*a* (and 50*b*) of the channel member. In FIG. 14, however, the side plates 10 and 11 are displaced relative to the channel member 50 longitudinally and in opposite directions, so that the end face 10*d* at one end of the length of the side plate 10 is recessed from the corresponding end face 52L*a* of the side wall 52L of the channel member, with the end face 10*e* at the opposite end of the length of the same side pate 10 projecting from the end face 52L*b* at the corresponding opposite end of the same side wall 52L, while the end face 11*d* at the corresponding one end of the length of the opposite side plate 11 projects from the corresponding end face 52R*a* of the other side wall 52R of the channel member, with the opposite end face 11*e* of the same side plate 11 being recessed from the corresponding opposite end face 52R*b* of the other side wall 52R.

Figure 15:
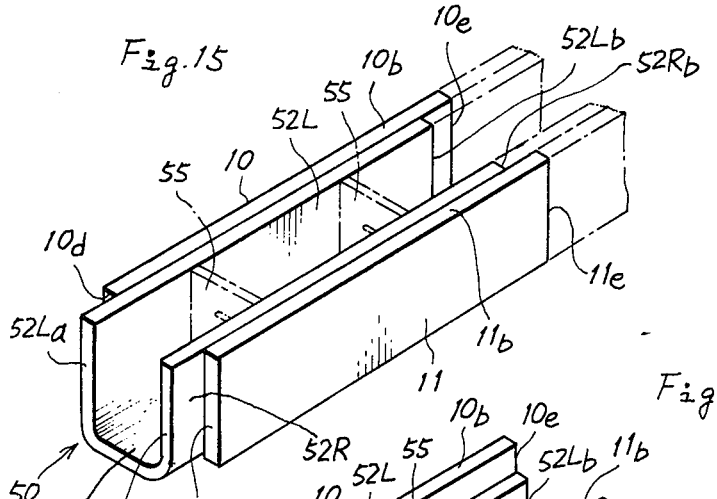

In the embodiment of FIG. 15, the side plates 10 and 11 are displaced relative to the channel member 50 longitudinally in the same direction, so that one longitudinal end portion of the channel member 50 projects from the corresponding longitudinal ends of the side plates 10 and 11 while the opposite longitudinal end portion of the channel member is recessed from the corresponding longitudinal ends of the side plates.

Figure 16:
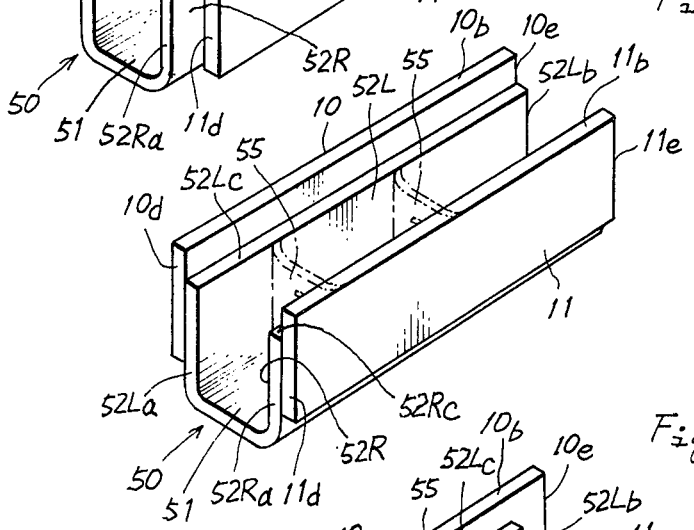

FIG. 16 shows a modified form of the embodiment of FIG. 13. A channel member 50 is provided between the side plates 10 and 11 and displaced vertically or widthwise thereof so that the bottom plate 51 of the channel member projects from the plane including the (lower) longitudinal edge surfaces 10*c* and 11*c* of the side plates, with the (upper) edge surfaces 52R*c* and 52L*c* of the side walls 52R and 52L of the channel member being recessed from the plane including the opposite (upper) longitudinal edge surfaces 10*b* and 11*b* of the side plates.

Figure 17:
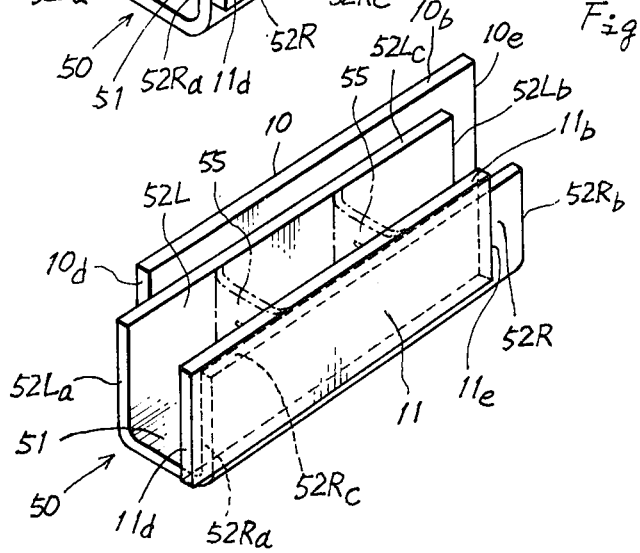

The embodiment of FIG. 17 is a combination of the arrangements of FIGS. 14 and 16. The channel member 50 is displaced both widthwise and lengthwise of the side plates, so that the bottom plate 51 of the channel member projects from the plane including the lower edge surfaces 10*c* and 11*c* of the side plates 10 and 11, with the upper edge surfaces 52R*c* and 52L*c* of the side walls 52R and 52L of the channel member being recessed from the plane including the opposite (upper) longitudinal edge surfaces 10*b* and 11*b* of the side plates 10 and 11, and at the same time the end face 52L*a* of the side wall 52L of the channel member projects longitudinally from the corresponding end face 10*d* of the side plate 10 attached to the side wall 52L, with the opposite end face 52L*b* of the same side wall 52L being recessed from the opposite end face 10*e* of the side plate 10, while the end face 52R*a* of the side wall 52R at the same end of the previously mentioned end face 52L*a* of the side wall 52L is recessed from the corresponding end face 11*d* of the opposite side plate 11 attached to the side wall 52R, with the opposite end face 52R*b* of the same side wall 52R projecting from the corresponding opposite end face 11*e* of the side plate 11.

Figure 18:
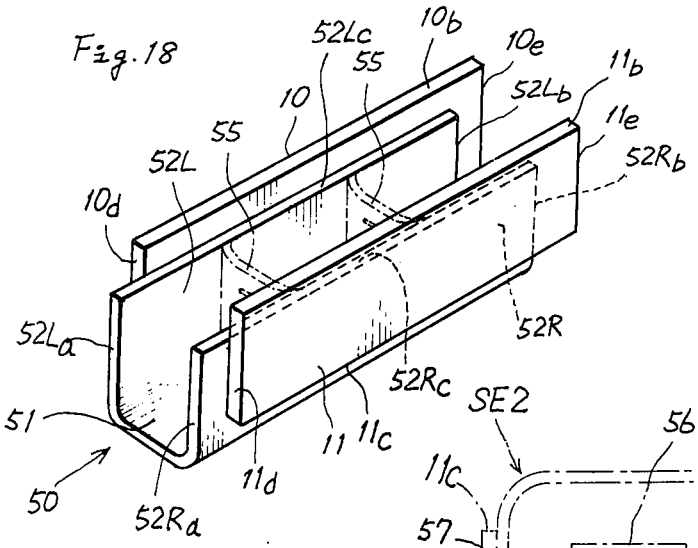

FIG. 18 shows an embodiment wherein both side plates 10 and 11 in the embodiment of FIG. 16 are displaced from the channel member 50 in the same longitudinal direction, so that one longitudinal end portion of the channel member projects from the corresponding longitudinal ends of the side plates while the opposite longitudinal end of the channel member is recessed from the opposite ends of the side plates, and at the same time the base plate 51 of the channel member projects from the common plane of the lower edge surfaces 10*c* and 11*c* of the side plates 10 and 11, with the upper edge surfaces 52R*c* and 52L*c* of the side walls of the channel member being recessed from the common plane of the upper edge surfaces 10*b* and 11*b* of the side plates.

In the embodiments of FIGS. 13 through 18, at least one stiffener plate 55 may be provided in the channel member 50, as shown by dot-and-dash lines. Each stiffener 55 has a width substantially equal to the distance between the opposite inner surfaces of the side walls 52R and 52L of the channel member and a height substantially equal to the depth thereof.

The stiffener has its opposite edge surfaces adhered by adhesive or otherwise fixed to the inner opposite surfaces of the channel member. Preferably, the stiffener is provided with a cut 56 extending linearly widthwise of the plate and at a suitable distance inwardly of the outer edge 57 thereof. If the stiffener is cut along two lines 58 from the outer edge 57, the portion of the stiffener surrounded by the cut lines 56 and 58 can be easily taken off so as to leave a recess 59 (FIG. 20), which enables passage of pipes and/or calbes therethrough in the same manner as in FIG. 10.

In FIGS. 13 to 15, the outer edge surface 57 of the stiffener is made flat or flush with the plane of the edge surfaces 10*b*, 11*b*, 52R*c* and 52L*c*. In FIGS. 16 to 18, however, the outer edge surface 57 of the stiffener is recessed or concavely curved so as to be complementary to the projecting or convexly curved outer surface of the base plate 51 of the channel member for the purpose to be described presently.

As can be easily understood, for axial connection of two elements as shown in FIGS. 13 to 18 a splice plate not shown may be fixed to, for example, the inner or outer surfaces of the adjacent end portions of the base plates of the channel members of the two elements to be connected. In the case of the elements of FIGS. 14, 15, 17 or 18, the engagement of the projecting end of one element in the opposite recessed end of the other elements provides an effective sealing between the abutting end faces of the two elements.

Figure 19:
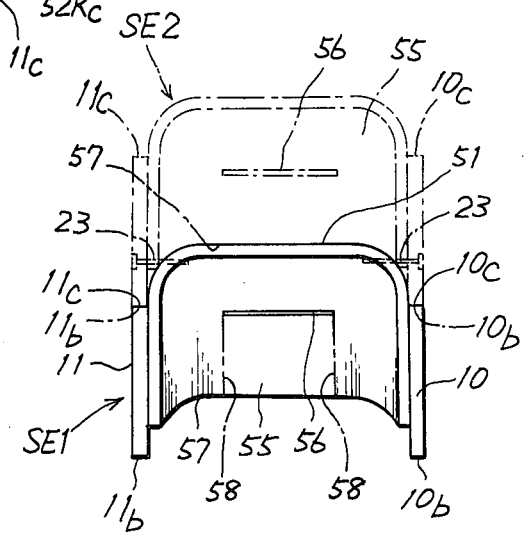
FIG. 19 is an end view showing a manner of assembling two elements shown in FIGS. 16, 17 or 18 one upon another.

FIG. 19 shows two structural elements SE1 and SE2 as shown in FIGS. 16, 17 or 18 assembled or piled one upon another, with the downwardly facing edge surfaces 10*b* and 11*b* of the side plates 10 and 11 of the upper element SE2 being fixed by adhesive to the upwardly facing edge surfaces 10*c* and 11*c* of the side plates of the lower element SE1. Nails 23 may be used in addition to the adhesive to make the bond stronger and securer. Without the adhesvie bond nails alone may be used.

The upwardly projecting bottom wall 51 of the channel member of the lower structural element SE1 is fitted in the complementarily contoured outer edge 57 of the stiffener plate 55 of the upper structural element SE2.

Figure 20:
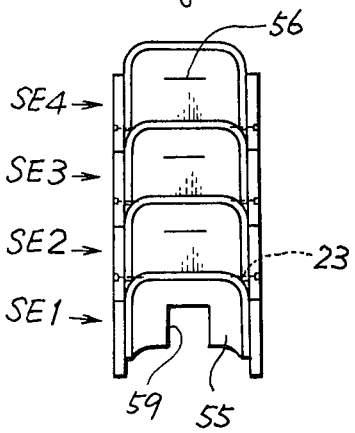
FIG. 20 is an end view of four elements in FIGS. 16, 17 or 18 piled one upon another.

FIG. 20 shows four structural elements SE1 to SE4 as shown in FIGS. 16, 17 or 18, piled one upon another in a manner similar to that shown in FIG. 19. As many structural elements as are desired may be assembled in a similar manner.

Figure 21:
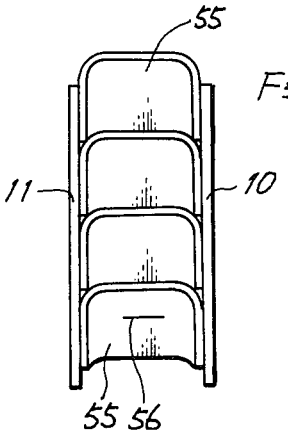
FIG. 21 is an end view of an embodiment of the invention wherein four channel members are piled up and sandwiched between a pair of side plates.

In FIG. 21 four channel members 50 are piled one upon another just as in FIG. 20. The embodiment of FIG. 21, however, differs from that of FIG. 20 in that the four channel members are sandwiched commonly between a sigle pair of side plates 10 and 11 each having a width (height) four times that of the side plates shown in the embodiment of FIG. 20.

As wide or large side plates as are desired may be used with as many channel members as are desired which are sandwiched between the side plates so as to provide as large a pannel as is desired to be used as a wall, floor, or ceiling.

Figure 22:
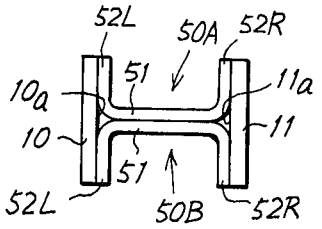
FIGS. 22 through 25 are end views of modified forms of the elements, wherein two U-shaped channel members are included.
Figure 22A:
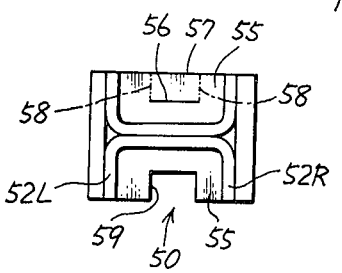

In the embodiment of FIG. 22 two channel members 50A and 50B are arranged between the side plates 10 and 11 in a back-to-back relation to each other.

The outer surfaces of the side walls 52L and 52R of the channel members are adhered by adhesive or otherwise fixed to the inner surfaces 10*a* and 11*a* of the side plates 10 and 11, with the outer surfaces of the base plate 51 being adhered by adhesive or otherwise fixed to each other.

Figure 23:
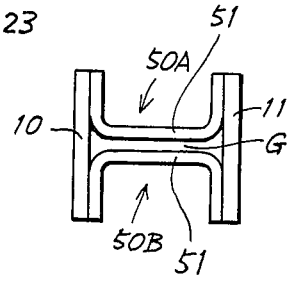
Figure 23A:
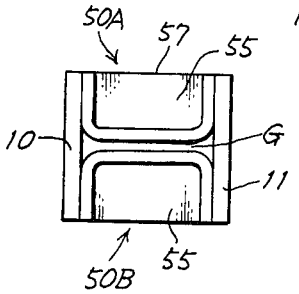

In the embodiment of FIG. 23 two channel members 50A and 50B are used as in FIG. 22, but with a small gap G between the opposite outer surfaces of the base plate 51 thereof.

Figure 24:
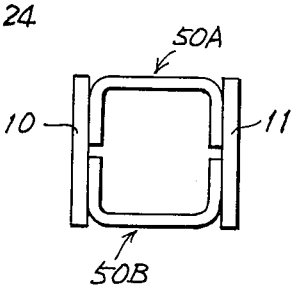
Figure 24A:
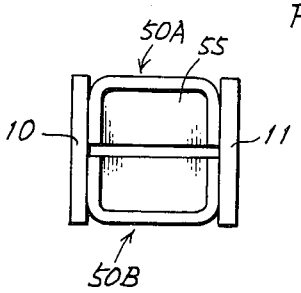

In the embodiment of FIG. 24, two channel members 50A and 50B are arranged between the side plates 10 and 11, with their respective inner surfaces facing each other so that the two side plates and the two channel members form a hollow body of an approximately square cross section.

Figure 25:
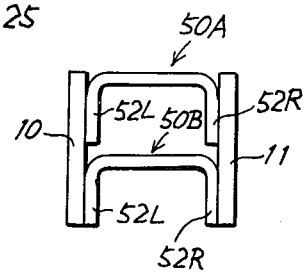
Figure 25A:
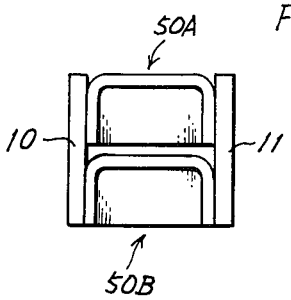

In the embodiment of FIG. 25, two channel members 50A and 50B are arranged one above the other, that is, with the side walls 52R and 52L thereof extending in the same direction, that is, downwardly in the figure.

Modifications of the arrangements of FIGS. 22 through 25 are shown in FIGS. 22A through 25A, respectively, wherein at least one stiffener plate 55 is provided in each of the channel members. The stiffener is similar to those shown in FIGS. 13 to 15 so that no explanation thereof will be given.

The structural elements of the invention may be of any desired dimension. It should be recognized that the dimensions or size of the illustrated embodiments are only for the purpose of explanation.

What I claim is:

1. A structural element for use as a component part of a building, comprising: a pair of parallel side plates having opposite surfaces spaced a predetermined distance apart from each other; and connecting means disposed between said opposite surfaces so as to rigidly connect and keep said side plates in said spaced-apart relation, said connecting means comprising a channel member of a substantially U-shaped cross section having substantially the same length of said side plates, said channel member comprising a pair of opposite side walls and a base plate connecting said side walls, the outer surfaces of said side walls being fixed to the inner surfaces of said side plates.

2. The structural element of claim 1, wherein one of said side plates is displaced relative to said channel member longitudinally in one direction so that one longitudinal end of said one side plate projects from the corresponding one longitudinal end of said channel member while the opposite longitudinal end of said one side plate is recessed from the corresponding opposite longitudinal end of said channel member, and the other of said side plates is longitudinally displaced relative to said channel member in the opposite direction to the direcion in which said one side plate is displaced so that one longitudinal end of said other side plate corresponding to said projecting end of said one side plate is recessed from said corresponding one end of said channel member while the opposite longitudinal end of said other side plate projects from said corresponding opposite longitudinal end of said channel member.

3. The structural element of claim 2, further including at least one stiffener plate disposed in said channel member so as to extend perpendicularly to said side walls of said channel member and having its edge surface fixed to the inner surface of said channel member.

4. The structural element of claim 3, wherein a cut is formed in said stiffener plate so as to enable easy formation of a recess from the outer free edge of said stiffener plate.

5. The structural element of claim 2, wherein said channel member is displaced relative to said side plates widthwise thereof so that the longitudinal edges of said side walls of said channel member are recessed from the corresponding longitudinal edges of said side plates to provide a pair of longitudinal steps along and inside said longitudinal edges of said side plates, while said base plate of said channel member projects from the opposite longitudinal edges of said side plates.

6. The structural elements of claim 5, further including at least one stiffener plate disposed in said channel member so as to extend perpendicularly to said side walls of said channel member and having its edge surface fixed to the inner surface of said channel member.

7. The structural element of claim 6, wherein a cut is formed in said stiffener plate so as to enable easy formation of a recess in the outer free edge portion of said stiffener plate.

8. The structural element of claim 1, wherein said channel member is displaced relative to said side plates lengthwise thereof so that one longitudinal end of said channel member projects from the corresponding longitudinal ends of said side plates while the opposite longitudinal end of said channel member is recessed from the corresponding opposite longitudinal ends of said side plates.

9. The structural element of claim 8, further including at least one stiffener plate disposed in said channel member so as to extend perpendicularly to said side walls of said channel member and having its edge surface fixed to the inner surface of said channel member.

10. The structural element of claim 9, wherein a cut is formed in said stiffener plate so as to enable easy formation of a recess from the outer free edge of said stiffener plate.

11. The structural element of claim 1, wherein said channel member is displaced relative to said side plates widthwise thereof so that the longitudinal edges of said side walls of said channel member are recessed from the corresponding longitudinal edges of said side plates to provide a pair of longitudinal steps along and inside said longitudinal edges of said side plates, while the base plate of said channel member projects from the opposite longitudinal edges of said side plates.

12. The structural element of claim 11, further including at least one stiffener plate disposed in said channel member so as to extend perpendicularly to said side walls of said channel member and having its edge surface fixed to the inner surface of said channel member.

13. The structural element of claim 12, wherein a cut is formed in said stiffener plate so as to enable easy formation of a recess in the outer free edge portion of said stiffener plate.

14. The structural element of claim 11, wherein said channel member is displaced relative to said side plates lengthwise thereof so that one longitudinal end of said channel member projects from the corresponding longitudinal ends of said side plates while the opposite longitudinal end of said channel member is recessed from the corresponding opposite longitudinal ends of said side plates.

15. The structural element of claim 14, further including at least one stiffener plate disposed in said channel member so as to extend perpendicularly to said side walls of said channel member and having its edge surface fixed to the inner surface of said channel member.

16. The structural element of claim 15, wherein a cut is formed in said stiffener plate so as to enable easy formation of a recess in the outer free edge portion of said stiffener plate.

17. A structural element for use as a component part of a building, comprising: a pair of parallel side plates having opposite surfaces spaced a predetermined distance apart from each other, connecting means comprising at least two channel members disposed between said opposite surfaces so as to rigidly connect and keep said side plates in said space apart relation, each of said channel members having a substantially U-shaped cross section and substantially the same length as said side plates, and comprising a pair of opposite side walls and a base plate connecting said side walls, the outer surfaces of said side walls being fixed to the inner surfaces of said side plates.

18. The structural element of claim 17, further including at least one stiffener plate disposed in at least one of said channel members so as to extend perpendicuraly to said side walls of said channel member and having its edge surface fixed to the inner surface of said one channel member.

19. The structural element of claim 18, wherein a cut is formed in said stiffener plate so as to enable easy formation of a recess in the outer free edge portion of said stiffener plate.

20. The structural element of claim 17, wherein said channel members are arranged in a back-to-back relation, with the outer surfaces thereof being attached to each other.

21. The structural element of claim 17, wherein said channel members are arranged in a back-to-back relation, with the outer surfaces thereof being spaced across a gap from each other.

22. The structural element of claim 17, wherein said channel members are piled one upon other.

23. The structural element of claim 17, wherein said channel members are arranged with their respective inner surfaces facing each other so that said side plates and said channel members form a hollow body of a substantially square cross section.

* * * * *